US006807908B2

(12) United States Patent
Brydges-Price

(10) Patent No.: US 6,807,908 B2
(45) Date of Patent: Oct. 26, 2004

(54) NON-PENETRATING PROJECTILE

(76) Inventor: Richard Ian Brydges-Price, Newton of Stracathro, by Brechin, Angus, Tayside (GB), DD9 7QQ ( * ) Notice: Subject to any disclaimer, the term of this patent is extended or adjusted under 35 U.S.C. 154(b) by 0 days.

(21) Appl. No.: 10/343,279

(22) PCT Filed: Jul. 24, 2001

(86) PCT No.: PCT/GB01/03320

§ 371 (c)(1),
(2), (4) Date: Jan. 28, 2003

(87) PCT Pub. No.: WO02/10671

PCT Pub. Date: Feb. 7, 2002

(65) Prior Publication Data

US 2004/0089186 A1 May 13, 2004

(30) Foreign Application Priority Data

Jul. 28, 2000 (GB) ..... 0018593

(51) Int. Cl.[7] ..... F42B 10/00; F42B 12/00
(52) U.S. Cl. ..... 102/512; 102/451
(58) Field of Search ..... 102/512, 451; 604/130, 137; 473/581

(56) References Cited

U.S. PATENT DOCUMENTS 3,584,582 A * 6/1971 Muller ..... 102/512
3,721,197 A * 3/1973 Hughes et al. ..... 102/451
3,820,465 A 6/1974 Delphia
4,243,036 A * 1/1981 Ott ..... 604/130
5,221,809 A 6/1993 Cuadros

FOREIGN PATENT DOCUMENTS

| | | | |
|---|---|---|---|
| DE | 2 260 529 | * 12/1972 | ..... 102/512 |
| DE | 19528348 | 11/1996 | |
| FR | 2789484 | 8/2000 | |
| GB | 2350414 | 11/2000 | |
| GB | 2 350 414 | * 11/2000 | ..... 102/512 |

* cited by examiner

*Primary Examiner*—Jack Keith
*Assistant Examiner*—L. Semunegus
(74) *Attorney, Agent, or Firm*—Horst M. Kasper

(57) ABSTRACT

A non-lethal projectile or a projectile for delivery of a substance (optional) has a tubular body casing (1) which surrounds a compartment (2) for containment of the substance. The compartment (2) coaxially supports a hollow tube (5) projecting forward within an ogival nose cap (8). An inflatable membrane (7) is located within the nose cap (8). On target impact the nose is displaced and permits a small amount of substance from compartment (2) to bleed through opening (6) allowing piston (4) to move forward uncovering ports (16). This action allows pressure gas to pass through the ports (16) and ducts to inflate the membrane (7). The piston is also free to move forward to discharge the substance through needle (5). The bag (7) thus expands rapidly and prevents excess penetration whilst spreading the impact energy over a wide area. The construction avoids the need for a charge to be contained within the projectile itself.

24 Claims, 2 Drawing Sheets

NON-PENETRATING PROJECTILE

This invention relates to a non-penetrating projectile which may be adapted for use as a medication delivery system, for example for delivering a tranquillising substance, drug, vaccine, medication, identification means or tracking device to an animal or to any other target. The system may also be used to take a sample of tissue. Such projectiles are commonly referred to as tranquilliser darts and their primary purpose is to provide means for remotely delivering and injecting a tranquillising fluid or medication into an animal without causing undue harm or stress.

This invention also relates to a projectile which can be adapted for use as a non-lethal projectile commonly referred to as a "baton round" or "rubber bullet".

With reference to the first mentioned us, there has long been a need to capture, study, relocate or medicate animals and various means are used. The most commonly used method being by means of some form of adapted syringe containing a tranquilliser which is propelled and injected on impact into the animal. These tranquilliser dart devices have serious disadvantages primarily being lack of range and accuracy due to poor ballistic properties and the highly parabolic trajectory making range estimation critical. As a projectile the devices are inherently unstable due to length and weight and cannot be spin stabilised to any useful degree due to the low velocity which is required to avoid deep penetration which is a major factor. The known devices are also complex to assemble and load often with highly toxic drugs and are heavy in relation to the delivered payload.

It is one object of this invention to provide a tranquilliser or other medication delivery system using a projectile, being preferably spin stabilised having improved range and accuracy and of an inherently stable ballistic shape, being an improvement and a modification of the projectile described and claimed in WO 00/71967A1 and GB2350414 A1.

Another alternative object is to provide a projectile which has limited, controlled or no penetration into a target.

Yet a further alternative object is to provide a projectile which itself does not include an explosive or gas producing charge.

A further alternative object of this invention to provide a non-lethal projectile which may be fired with accuracy at a soft target directly and even at close ranges and which is designed not to penetrate to any significant extent and which should only cause minimal injury to the limbs or torso.

Another alternative object is to provide a projectile which is capable of marking the target for subsequent identification.

In accordance with a first aspect of this invention there is provided a projectile including means to effectively retard the velocity of the projectile on impact with a target wherein the velocity is retarded in such a way as to prevent excess injury or penetration by deployment of means, following impact with a target, which rapidly expands to produce a large increase in the area at the nose of the projectile to spread the kinetic energy over a large area, characterised in that said expansion of said means is effected using a pressurised gaseous medium carried in the projectile.

Preferably the velocity retarding means comprises an inflatable membrane which is subject to the pressurised medium through means actuated on impact with a target, for example by a impact sensor or by means of a proximity sensing means, or by physical displacement actuating a valve device, the membrane being inflated using said pressure, preferably being gas pressure, stored in the projectile and preferably derived from the propulsive charge gases occurring on firing the projectile from a weapon.

In accordance with a second aspect of this invention there is also provided a projectile with means to effectively retard the velocity of the projectile on impact with the target for the purpose of preventing penetration, wherein the velocity retarding means comprises an inflatable membrane actuated on or close to impact, for example by a impact sensor or by means of a proximity sensing means, the membrane being inflated using gas pressure stored in the projectile, said pressure being preferably derived from the propulsive charge gases occurring on firing from a weapon.

In accordance with a third aspect of this invention there is provided a projectile comprising a rear canister part and a forward nose part connected therewith, the canister part containing or adapted to contain a pressure gas, the forward end of the canister part having a valve means, the nose part comprising a profiled impact deformable material with a portion to act on and open the valve following impact, the nose part having a membrane around the deformable material, the membrane being inflated on release of the pressure gas through opening of the valve.

The velocity is retarded in such a way as to prevent excess injury or penetration and may be achieved by means which rapidly produces a large increase in area at the nose of the projectile thus spreading and dissipating the kinetic energy over a large area.

Preferably the projectile is adapted to be fired from a barrel weapon which may be rifled to impart spin. The projectile may be of sub-calibre design using a discarding sabot and be fired in a barrel having progressive rifled pitch to attain a velocity greater than 500 m/s.

In one preferred construction the projectile has a body with a cavity containing a payload, such as a marker fluid or dye and an ogival nose.

The velocity retarding means comprises a means to significantly increase the area of the projectile nose portion on initial impact by inflation to produce unfurling or unfolding, or by expansion through stretching or by a combination of both.

In one construction the velocity retarding means comprises an inflatable membrane which opens up or expands through gas pressure and actuated by a sensor on initial impact or using a proximity sensing means.

In an alternative the membrane is pre-pressurised and expands following discarding of an overlaying covering forming a constraining means.

The membrane may be inflated through a detonator and gas producing explosive charge or through use of stored gas pressure. This charge or stored pressure may also serve for the purpose of dissipating the marker by driving a piston in the containing cavity.

The membrane can be located in the nose of the projectile comprising a readily broken, fragmenting, unfurling or deployable cap, The membrane may be in the form of a bag attached to and around a forward end of the projectile nose thus preventing penetration beyond a predetermined depth.

The nose part of the projectile may include a solid foam-like or gel-like substance forming an energy absorbing material which spreads on impact. More specifically the gel may comprise a nano-porous open cell foam of the kind known by the trade mark Aerogel.

This invention is further described and illustrated with reference to the drawings showing a modification of the embodiment disclosed in patent application WO 00/71967A1 and further embodiments according to this invention all shown by way of examples only. In the drawings.

Figure 1:
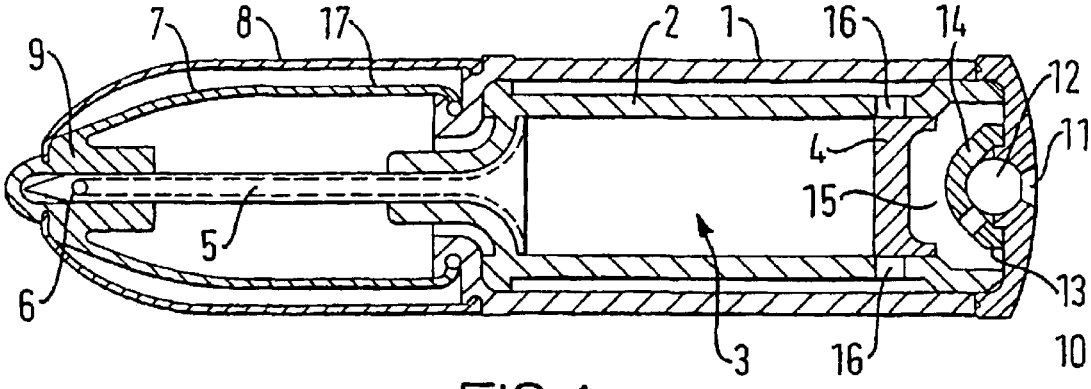
FIG. 1 shows an embodiment of projectile, in longitudinal section, which uses stored gas pressure.
Figure 2:
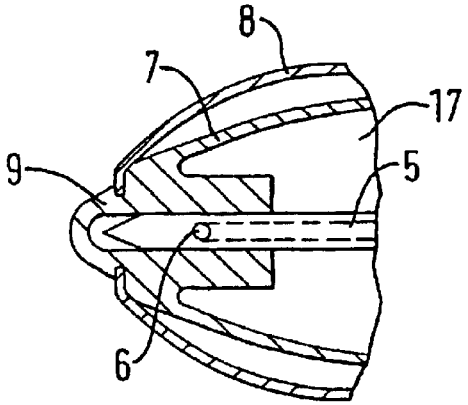
FIG. 2 shows a detail of the nose of the projectile of FIG. 1.
Figure 3:
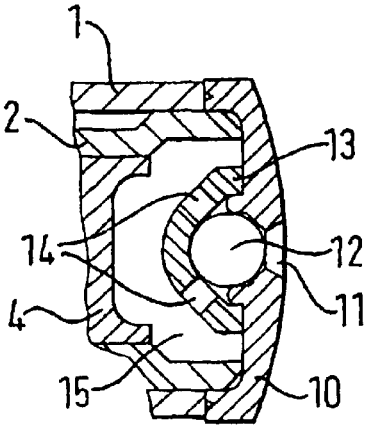
FIG. 3 shows a detail of the base of the projectile of FIG. 1.

The embodiment is shown FIGS. 1 to 3 of the drawings is similar to that disclosed in WO 00/71967A1 but here gas pressure for inflating the bag and injecting the substance is derived from propulsion gases on firing the projectile. This arrangement avoids the need for the projectile itself to contain a gas producing charge.

As shown in FIGS. 1 to 3 the projectile has a casing 1 surrounding a compartment 2 to contain the substance to be injected at 3 and a piston 4 which serves to drive the substance 3 forward through the needle 5 to exit via one or more orifices 6. Surrounding the needle 5 is an expandable membrane 7 which may be of rubber or the like and capable of inflating in the manner of a balloon. The nose of the projectile has a casing 8 which supports an end plug 9 of the membrane 7, this plug 9 also supporting the end of needle 5.

The base of the projectile comprises and end cap 10 ultrasonically welded to the casing 1. The end cap 10 has an orifice 11 with an internal seat against which a deformable, for example rubber, bead or cone 12 is pressed by an internal bridge 13. The bridge 13 has apertures 14.

The projectile may be integrated with a propellant charge carrying casing or may be caseless. The operation is as follows:

When the projectile is fired from weapon gas pressure from the propulsive charge will be about 600 atmospheres sufficient to deform the bead 11 thus allowing pressure gas to enter via orifices 11 and 14 to the reservoir space 15 behind piston 4. Once the projectile leaves the muzzle of the weapon internal pressure in the reservoir 15 forces bead 11 back onto the seat and closes the orifice 11.

On impact with a target the nose plug 9 is moved back over the needle 5 exposing the orifice 6 to permit some substance 3 in the cavity 2 to bleed thus allowing piston 4 to move forward. This movement uncovers apertures 16 in the wall of compartment 2 and permits stored gas pressure in compartment 15 to enter the cavity between casing 1 and compartment 2. This compartment connects through passageways with the cavity 17 inside the membrane 7 and thus rapidly inflates same. Where the membrane is of rubber it will stretch and expand. The membrane could be of a non- or partly-stretchable material which is folded into the nose cone. During this action the nose 8 is split open and is discarded or peels back.

It will be appreciated that the sequence of events occurs rapidly in relation the velocity of the projectile resulting in minimum penetration of the needle. The balloon-like inflation of the membrane 7 also has the effect of pushing the projectile back relative to the target thus withdrawing the needle 5 with the projectile falling to the ground. Modifications to the form of the membrane on inflation may be made in order to permit the projectile to be retained in the target if required.

Figure 4:
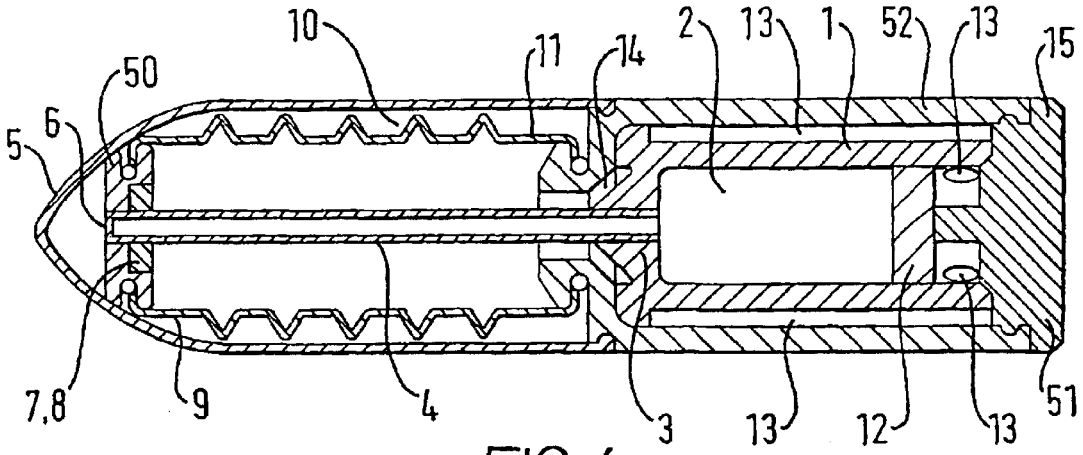
FIG. 4 shows a longitudinal cross-section of a non-lethal disabling or marking projectile, which may optionally use stored gas pressure.

Referring to FIG. 4 of the drawings the projectile shown comprises a tubular body casing 1 which may, if required, define a cavity 2 for containment of a marker or dye for example a fluid. The fluid may be stabilised by means of a sponge or similar material to prevent inertia to spin which may create instability in flight.

Located towards the tip of a nose cap 5 is a gas producing detonator 7 fired by an impact fuse 8. In an alternative arrangement two, or more, otherwise inert substances are to be brought together to initiate an action. Attached to the detonator 7 is the neck 9 of an inflatable membrane or bag 10 of which an opposed end 11 is attached to the plug 3. A readily deformable tube 4 connects the detonator assembly 7 to the plug 3 and acts as a support. The rear end of the cavity 2 has a piston 12 the rear end of which communicates through concentric passageways 13 around the cavity 2 and ducts 14 in the plug 3 with the interior of the bag 10. The rear end of the casing 1 is closed off by a tail piece 15.

The projectile has an inherently stable ballistic shape and may have a mass of about 8 to 10 grammes and be some 1.5 cm in calibre. Larger or smaller calibre may be used as appropriate to the circumstances. The projectile may be embraced by a discarding sabot of plastics material and may be fired from a standard or progressive pitch rifled barrel giving a muzzle velocity of about 500 m/s. The range under these conditions should be of the order of 150 m with a mid range trajectory fall of less than 20 cm.

The nose cap 5 is of a readily frangible plastics material and may include structural lines of weakness to facilitate fragmentation. The inflatable bag 10 may be of Kevlar material, latex or silicone as examples of suitable materials. An impact absorbing material such as Aerogel may be contained in the nose cap. A marking dye substance may also be included.

In use, and following discharge from the weapon, the nose 5 will make initial impact and the detonator 7 is driven back along the support tube and fired via the ignition and retention cuff forming a fixed pin assembly 8 to thus inflate the bag 10 rapidly. The bag 10 expands and prevents excess penetration whilst spreading the impact energy over a wide area. On inflation of the bag the nose cap 5 is broken open and may be discarded. In an alternative arrangement the nose cap 5 may spread open in a petaline manner and add to the retardation effect. The bag may be striated longitudinally or laterally and coated or impregnated with gas producing chemical compounds to both accelerate expansion and strengthen the bag membrane. The bag inflation gas bleeds through ducts 14 and passageways 13 to drive piston 12 forward thus ejecting the marker through the tube 4.

In a modification excess gas pressure is used to further retard the projectile by forward facing discharge nozzles.

In a modification of this embodiment the cavity behind piston 12 or the cavity 2 is charged with a pressurised gas which may be collected from rearward ports which are exposed to the propulsive charge on firing and trapped by one-way valve means. The gas is released to inflate the membrane 10 on impact In this embodiment the bag 10 is folded in the manner of a bellows as shown, to provide greater expansion capability, and retained at the nose, within the cap 5, by an annular support 50 holding the detonator charge. This support 50 also centralises the tube 4,6 and closes the nose completely. The tail piece 15 comprises a removable plug 51 to permit filling of the cavity 2. The container 1 here is a removable module carrying the tube 4 and is housed within the projectile outer case 52.

The propellant charge for the projectile may be included within an integral cartridge casing forming a single piece round. The projectile may be a single use device pre-loaded with a defined marker and charge with different charges being coded for ease of field use. The casing may comprise a carbon fibre material or glass bonded hydrocarbon matrix.

The projectile may be packaged in such a way that arming only occurs when removed from the pack.

The projectile has a particular use for soft targets presently require firing at close range typically 20 m.

Figure 5:
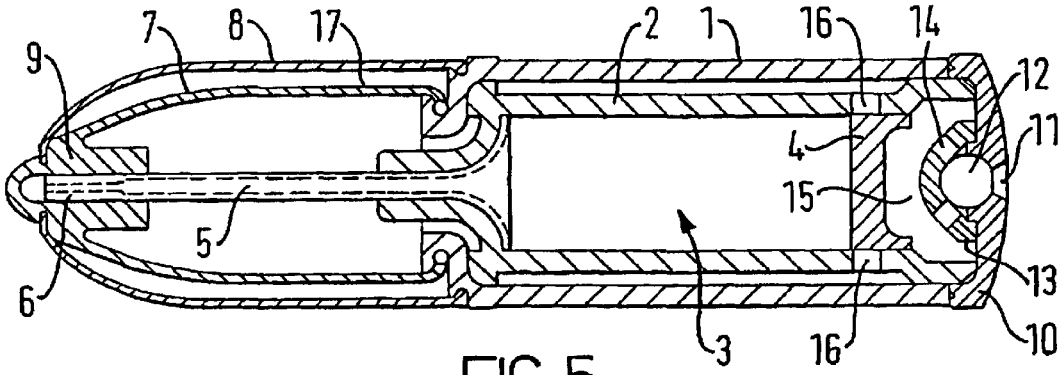
FIG. 5 shows a longitudinal cross-section of a non-lethal disabling or marking projectile which uses stored gas pressure derived from the propulsive charge.

A further advantageous embodiment is shown in FIG. 5 and is similar in concept to the embodiment of FIG. 1, with gas pressure for inflating the bag and ejecting the marker substance being derived from propulsion gases formed on firing the projectile. This arrangement also avoids the need for the projectile itself to contain a gas producing charge. The previously described embodiment of FIG. 4 may be modified to include a pressurised gas compartment or capsule rather than an explosive gas producing compound. This would make distribution and compliance with regulations easier.

As shown in FIG. 5 the projectile is in many respects similar to that of FIG. 1 and includes a pressure gas storage chamber. The projectile has a casing 1 surrounding a compartment 2 to contain the marker substance to be ejected at 3 and a piston 4 which serves to drive the marker substance 3 forward through the tube 5. Details are otherwise similar to FIGS. 1 to 3.

Figure 6:
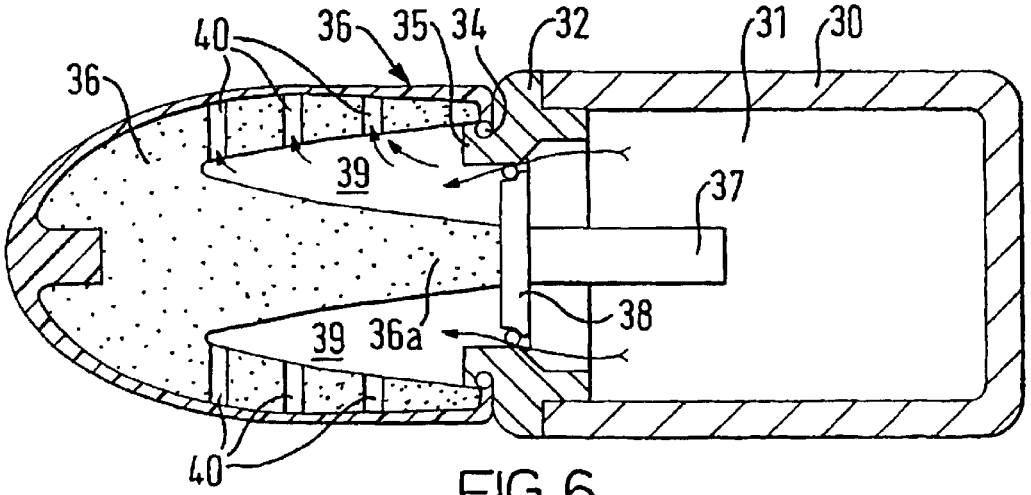
FIG. 6 shows a construction of baton round according to this invention using stored gas pressure.

FIG. 6 shows a construction of baton round according to this invention using stored gas pressure.

Referring to FIG. 6 the projectile has an inherently stable ballistic shape and may have a mass of about 10 to 150 grammes and be some 10 to 50 mm in calibre. Larger or smaller calibre may be used as appropriate to the circumstances. The projectile may be embraced by a discarding sabot of plastics material and may be fired from a standard or progressive pitch rifled barrel giving a muzzle velocity of about 500 m/s. The range under these conditions should be of the order of 150 m with a mid range trajectory fall of less than 20 cm.

In the construction shown the projectile comprises a rear canister 30 forming a pressure gas reservoir 31 either pre-filled or filled by combustion gases on firing or by gases from a detonator and charge unit 37 and with a forward closure 32 retaining an expandable membrane or cover bag 33. The bag 33 is connected by an interlock 34 to a rim 35 on the closure 32. The shape of the bag 33 is maintained and supported by a viscous filler 36 such as Aerogel (a Trade Mark). The bag 33 may be protected by a nose cone being relatively thin and easily deformed or broken on initial impact.

On impact with a target the Aerogel deforms and crushes initially and a valve 38 opens by rearward movement of the stub part 36*a* of the Aerogel. Pressure gas from the reservoir 31 or alternatively generated by the detonator unit 37 on impact, for example using an inertia detonator, enters cavity 39 past the valve 38 and passes through ducts 40 to expand the bag 33.

As described the pressure gas for inflating the bag 33 may be derived from either an inertia detonator with gas producing charge 37, from gas stored in the container 31 or from the gases produced from the propulsive charge on firing using ports at the base which are exposed to the propulsive gases with intervening valve means to retain the gas pressure.

In another option the inertia detonator will initiate filling of the rear cavity 31 with pressurised gas on firing and this pressure is retained during flight against the valve plate 38. In another alternative a pressurised capsule may be incorporated to replace the inertia detonator.

A marker dye could be included between the nose cone and the inflatable membrane.

In a modification excess gas pressure is used to further retard the projectile by forward facing discharge nozzles.

The propellant charge for the projectile may be included within an integral cartridge casing forming a single piece round. The projectile may be a single use device pre-loaded with a defined marker and charge with different charges being coded for ease of field use. The casing may comprise a carbon fibre material or glass bonded hydrocarbon matrix.

The projectile may be packaged in such a way that arming only occurs when removed from the pack.

The projectile may be integrated with a propellant charge carrying casing or caseless.

It will be appreciated that the sequence of events occurs rapidly in relation the velocity of the projectile resulting in no, or minimal, penetration of the nose. The balloon-like inflation of the membrane also has the effect of pushing the projectile back relative to the target thus adding to the blow inflicted on the target.

The membrane used may comprise an expandable rubber material which stretches or the material may comprise KEVLAR (a registered Trade Mark) weft which initially inflates, then expands and finally allows gas pressure to bleed due to opening-up of the weave. In all embodiments a pressure relief system may be included to avoid over extending the inflation of the membrane.

What is claimed is:

1. A projectile having a nose part and a body part the nose part including means to effectively retard the velocity thereof on impact with a target in such a way as to prevent excessive damage, injury or penetration at the target, the said means comprising an inflatable membrane operatively connected to a container in the body part of the projectile for storage of a pressurized gas or storage of a pressurized gas producing means, a release means to effect release of the pressure gas into the membrane to produce a rapid expansion in volume of said membrane to produce a large increase in the area at the nose of the projectile following impact with a target.

2. A projectile in accordance with claim 1, including a delivery device for release of a substance to the target, the projectile including a cavity to contain such substance and means to release the said substance at a point of impact with a target, the inflatable membrane being inflated on impact with a target by a sensor device operative to release the gas pressure stored in the container to the membrane.

3. A projectile in accordance with claim 2, wherein the gas pressure container is operatively associated with the delivery device for the purpose of releasing the said substance.

4. A projectile in accordance with claim 1, in combination with a cartridge for firing the projectile from a gun the rear of the projectile body having a valved orifice leading to a reservoir chamber forming the storage means for propulsive gas pressure, said gas pressure being derived from the propulsive gas produced by the cartridge on firing from the said gun.

5. A projectile in accordance with claim 4, wherein the reservoir chamber includes a piston acted on by the pressure gas the piston being displaced by the pressure gas to discharge the substance and inflate the membrane following impact with a target.

6. A projectile in accordance with claim 5, wherein on initial impact with a target the said substance within the cavity commences to discharge thus allowing the piston to initially move to expose a passageway through which gas pressure is released to inflate the membrane.

7. A non-lethal projectile having a body defining a cavity and a nose connected therewith, the body housing a pressure gas storage container, or a pressure gas producing charge located in a pressure gas storage container, the nose including a deformable or malleable substance located within an outer casing, the outer casing having an overlying membrane internally communicating with the pressure gas storage container and forming a means to effectively retard the velocity of the projectile on impact with a target, the membrane being inflatable by said pressure gas to produce a rapid volumetric increase in the membrane at or close to impact with a target.

8. A projectile in accordance with claim 7, wherein pressure gas stored in the projectile is derived from the propulsive charge gases occurring on firing from a weapon.

9. A projectile in accordance with claim 7, wherein the pressure gas is generated at or close to impact by a gas producing charge ignited by a detonator.

10. A projectile in accordance with claim 1, wherein the gas pressure also disperses a payload carried by the projectile.

11. A projectile in accordance with claim 1, wherein the membrane comprises a stretchable elastic material located around the projectile nose.

12. A projectile in accordance with claim 11, wherein the membrane forms the external surface of the nose of the projectile.

13. A projectile in accordance with claim 1, wherein the membrane is a bag which is contained within the nose of the projectile in a folded or pleated to condition, the bag comprising a reinforced fabric which is semi-permeable to gases affording relatively slow diffusion of as following inflation.

14. A projectile in accordance with claim 1, wherein the nose part of the projectile further includes a deformable or malleable impact absorbing material which spreads on impact.

15. A projectile in accordance with claim 14, wherein the said material is a solid foam-like or gel-like gel composition having a nano-porous open cell foam structure.

16. A projectile in accordance with claim 1, wherein the body part comprises a canister connected with the nose part, the canister containing a pressure gas or pressure gas producing means, the forward end of the canister having a valve means, the nose part comprising a profiled impact deformable material with a portion to act on and open the valve following impact with a target, the nose part having a membrane around the deformable material, the membrane being inflated on release of the pressure gas from the canister through opening of the valve.

17. A projectile in accordance with claim 16, wherein the membrane is protected by a nose cone or covering.

18. A projectile in accordance with claim 1, constructed as a sub-calibre discarding sabot projectile.

19. A projectile in accordance with claim 1, wherein the container is associated with two, or more, otherwise inert substances which, when brought together, produce pressure gas for storage in said container.

20. A projectile in accordance with claim 1, wherein the said pressure gas producing means comprises two or more substances which, in combination, generate pressure gas.

21. A projectile in accordance with claim 1, wherein the container is connected through a valve in the base of the body part, the valve permitting charging of the container with pressure gas on firing the projectile from a gun.

22. A projectile in accordance with claim 1, wherein the pressure gas is stored within a capsule forming the pressure gas producing means.

23. A projectile in accordance with claim 1, wherein the pressurized gas producing means comprises a detonator activated on impact of the projectile.

24. A projectile in accordance with claim 1, wherein the pressurized gas producing means comprises a detonator activated on firing of the projectile from a gun.

* * * * *